United States Patent [19]

Planck et al.

[11] 4,029,174

[45] June 14, 1977

[54] ADJUSTABLE LEGS FOR LADDER

[76] Inventors: James L. Planck, c/o George Spector 3615 Woolworth Building, 233 Broadway; George Spector, 3615 Woolworth Building, 233 Broadway, both of, New York, N.Y. 10007

[22] Filed: Apr. 6, 1976

[21] Appl. No.: 674,115

[52] U.S. Cl. ..... 182/204
[51] Int. Cl.[2] ..... E06C 7/44
[58] Field of Search ..... 182/201, 204; 248/188.2, 188.4, 188.8

[56] References Cited

UNITED STATES PATENTS

| | | | |
|---|---|---|---|
| 332,684 | 12/1885 | Tuttle | 182/201 |
| 2,213,471 | 9/1940 | Minnick | 182/201 |

*Primary Examiner*—Reinaldo P. Machado

[57] ABSTRACT

A ladder designed for standing upon an inclined or other uneven surface; the ladder in one design having a metal block secured to a lower end of each leg, each block having a threaded vertical opening in which a threaded extension is vertically adjustable, a lower end of the extension having plate with a skid-proof bottom.

2 Claims, 4 Drawing Figures

ADJUSTABLE LEGS FOR LADDER

This invention relates generally to ladders.

It is generally well known that a great many of persons are injured each year caused by falling from ladders, particularly when a ladder is standing upon an unstable base. Often a person is obliged to stand a ladder upon an inclined ground when painting a house or doing other outdoor work, so that one leg of ladder is too short for resting upon a ground. The conventional practice is to place a block of wood or a large rock under the short leg so that the ladder extends upward without any sideward incline. Or if the incline seems relatively slight, the person will prefer to ignore it and trust that the ladder's sideward incline is not serious enough to consider. Both practices are dangerous, as the blocking might be pushed out of the ladder weight and the inclined ladder with a person's weight on top might fall. This situation is objectionable and is, therefore, in want of an improvement.

Accordingly, it is a principal object of the present invention to provide an improved ladder having an extension at the lower end of each leg, the extensions being adjustable individually in length so to overcome the above described situation.

Another object is to provide an improved ladder which can be used out-of-doors or inclined or rough ground or which can be used indoors such as upon a staircase with each ladder leg on a different stair step.

Yet another object is to provide an improved ladder with adjustable extensions which is quick and readily adjustable without necessity of any tools and which is safe.

Other objects are to provide adjustable legs for a ladder which are simple in design, inexpensive to manufacture, rugged in construction, easy to use and efficient in operation.

These and other objects will be readily evident upon a study of the following specification and the accompanying drawing wherein.

Figure 1:
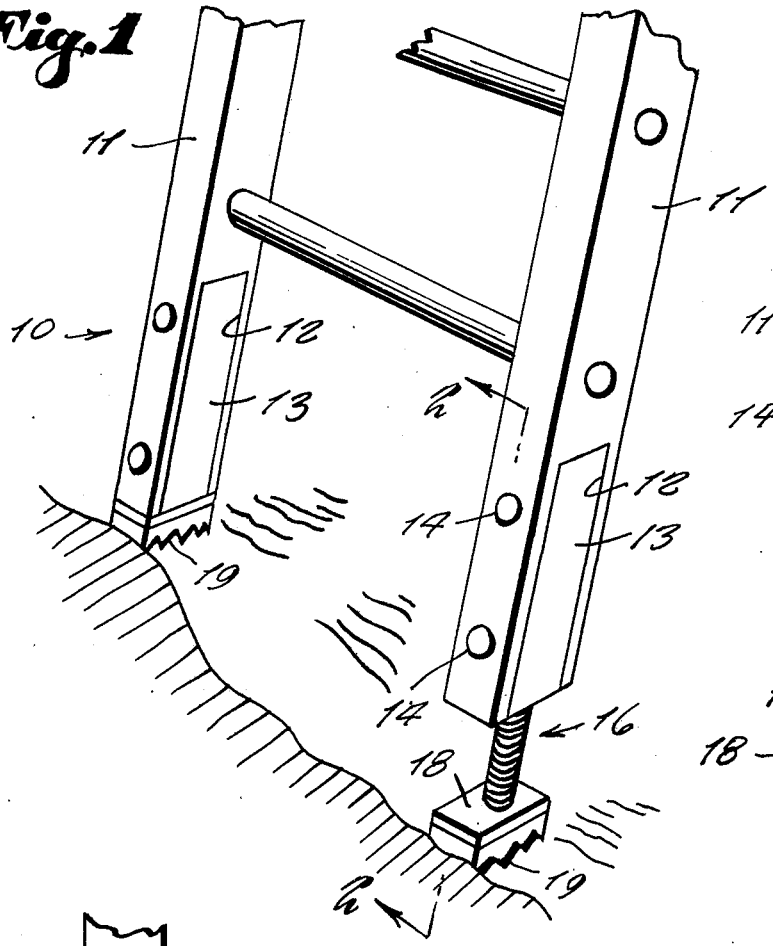
FIG. 1 is a perspective view of a ladder lower end showing the invention installed therewith.
Figure 2:
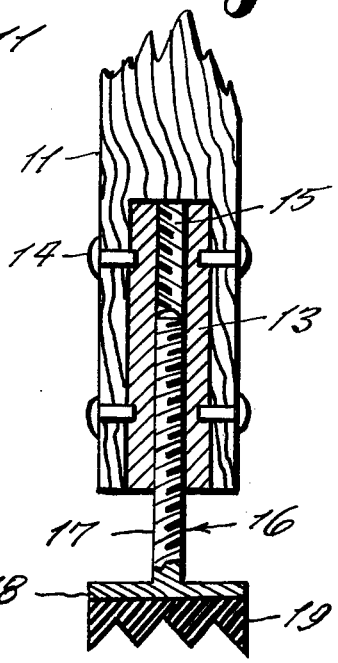
FIG. 2 is an enlarged cross section on line 2—2 of FIG. 1.

Referring now to the drawing in detail, and more particularly to FIG. 1 and 2 thereof at this time, the reference numeral 10 represents an improved ladder according to the present invention wherein there is a pair of ladder legs 11 each having a notch 12 at its lower end fitted with a stationary metal block 13 secured thereto by rivets 14. A vertical threaded opening

15 in the block receives a metal extension 16 that includes a threaded shank 17 having a plate 18 at its lower end, the underside of the plate having a skid proof, rubber sole 19 secured thereto having cleats for frictionally bearing against a ground.

In operative use, it is now evident as shown in FIG. 1, if the ground is sloped at an angle, one extension is screwed into a lower position than the other so that both extensions rest firmly on the ground without the ladder being sidewardly inclined. Thus the ladder is safe for use.

Figure 3:
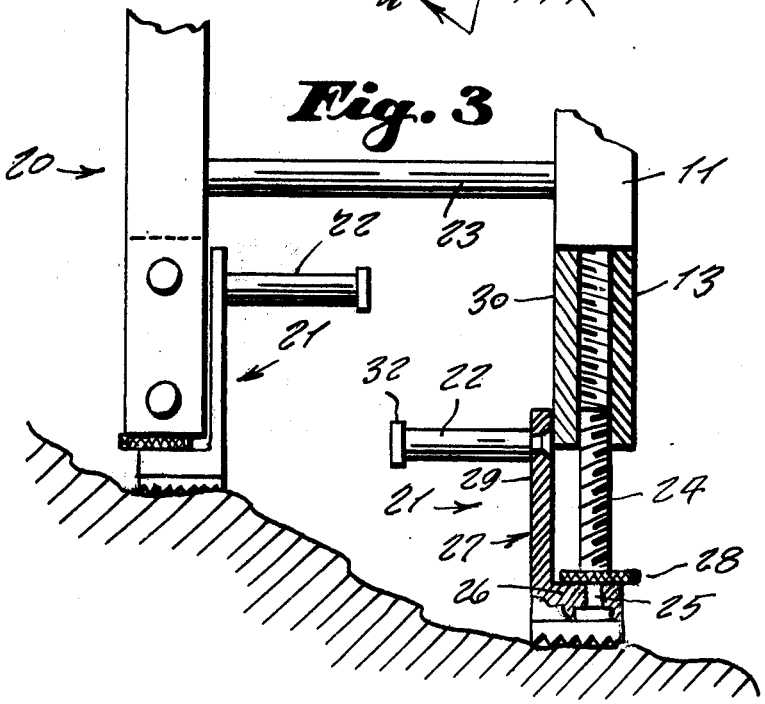
FIG. 3 is a front elevation view of FIG. 1 shown partly in cross section, and showing a modified design of the invention in which the foot is made non-rotatable so to carry a rung upon which a person can step so that if the adjustable leg is extended far, the rung makes it easier for a person to get on or off the ladder.
Figure 4:
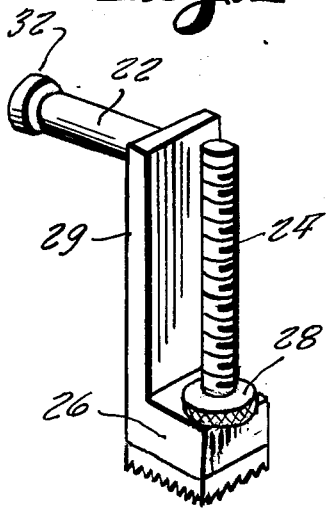
FIG. 4 is a perspective view of one of the legs shown in FIG. 1.

In FIGS. 3 and 4 another design 20 of the invention is shown wherein each extension 21 additionally includes a rung 22 that adjusts vertically together with the extension so that a person does not find it difficult to reach the lowest rung 23 of the ladder on the side at which the ground is farthest away therefrom due to the ground incline, as shown in FIG. 3.

In this form of the invention, the same above described block 13 is used engaging a threaded shank 24 which is freely rotatable at its lower end in an opening 25 in a horizontal arm 26 of an extension 27. The shank includes a knurlled knob 28 integral therewith so to make it easy for the shank to be manually rotated in order to vertically adjust the extension. A vertical arm 29 integral with arm 26 serves to slide alongside a side face 30 of the block 13 and serves also to prevent the extension from rotating. The sideward rung 22, underneath rung 23, is made of metal and is rigidly secured to an upper portion of the arm 29. An enlarged knob 32 on the end of the rung 31 serves as a stop to prevent a person's foot to slide off the end of the rung when stepping thereupon; it being noted that the rungs 31 are each only one-half as long as rung 23 so that the rungs 31 can fit next to each other when the extensions are evenly extended.

Thus a modified design is provided.

While various changes may be made in the detail construction it is understood that such changes will be within the spirit and scope of the present invention as is defined by the appended claims.

What is claimed is:

1. In an improved ladder for standing upon inclined or other terrain, the combination of a pair of spaced apart legs with a plurality of rungs therebetween, a lower end of each leg having a notch, a metal block rigidly affixed in each said notch a threaded vertical opening in each said block, and adjustable extension means screwed in each said threaded opening wherein said extension means comprises a threaded shank supported freely rotatable at its lower end in a horizontal arm of an L-shaped extension that includes a vertical arm slidable alongside said metal block, said vertical arm having a sideward rung rigidly affixed hereto.

2. The combination as set forth in claim 1 wherein said extension rung is one half a length as said rungs of said ladder.

* * * * *